US006655275B2

(12) United States Patent
Mugrauer

(10) Patent No.: US 6,655,275 B2
(45) Date of Patent: Dec. 2, 2003

(54) MULTI-COLOR PRINTING DEVICE HAVING INK AND LASER PRINTING UNITS

(75) Inventor: Hubert Mugrauer, Zorneding (DE)

(73) Assignee: Océ Printing Systems GmbH, Poing (DE)

( * ) Notice: Subject to any disclaimer, the term of this patent is extended or adjusted under 35 U.S.C. 154(b) by 188 days.

(21) Appl. No.: 09/902,233

(22) Filed: Jul. 10, 2001

(65) Prior Publication Data

US 2001/0038767 A1 Nov. 8, 2001

Related U.S. Application Data

(62) Division of application No. 09/402,755, filed as application No. PCT/DE98/01010 on Apr. 8, 1998, now Pat. No. 6,305,858.

(30) Foreign Application Priority Data

Apr. 10, 1997 (DE) ..... 197 14 951

(51) Int. Cl.[7] ..... B41F 13/54

(52) U.S. Cl. ..... 101/228; 101/483; 400/611; 347/104

(58) Field of Search ..... 101/228, 178, 101/179, 180, 219, 220, 221, 211, 483; 347/101, 104; 400/611, 613

(56) References Cited

U.S. PATENT DOCUMENTS

| | | | | |
|---|---|---|---|---|
| 4,658,723 A | * | 4/1987 | Tokuno et al. | 101/181 |
| 5,140,674 A | | 8/1992 | Anderson et al. | |
| 5,381,220 A | | 1/1995 | Acquaviva et al. | |
| 5,505,128 A | | 4/1996 | van den Brink | |
| 5,568,246 A | | 10/1996 | Keller et al. | |
| 5,587,771 A | * | 12/1996 | Mori et al. | 399/72 |
| 5,625,758 A | * | 4/1997 | Schneider et al. | 358/1.15 |
| 5,710,582 A | | 1/1998 | Hawkins et al. | |
| 5,711,225 A | * | 1/1998 | Rasmussen | 101/483 |
| 5,724,437 A | * | 3/1998 | Bucher et al. | 382/112 |
| 6,019,046 A | * | 2/2000 | Rodi | 101/479 |

FOREIGN PATENT DOCUMENTS

| | | |
|---|---|---|
| DE | 34 16 252 | 11/1984 |
| DE | 195 00 169 | 7/1995 |
| EP | 0 737 570 | 10/1996 |
| EP | 0 778 151 | 3/2000 |
| JP | 5-301387 | 11/1993 |

OTHER PUBLICATIONS

Abstract of Japanese 05–061621 of Mar. 12, 1993, *Patent Abstracts of Japan*, vol. 017, No. 381 (P1574) Jul. 16, 1993.
Abstract of Japanese 08–221233 of Aug. 30, 1996, *Patent Abstracts of Japan*, vol. 96, No. 12, Dec. 26, 1996.

* cited by examiner

*Primary Examiner*—Ren Yan
(74) *Attorney, Agent, or Firm*—Schiff Hardin & Waite

(57) ABSTRACT

A printing press has a conveying path for a paper web formed by rollers and has at least one high performance printing unit arranged at the conveying path, a plurality of ink jets or multi-color printing units being arranged along the conveying path at intervals in a row and a paper web intermediate store is located in the conveying path preceding each of the ink jet or multi-color printing units, as viewed in the paper conveying direction.

15 Claims, 2 Drawing Sheets

MULTI-COLOR PRINTING DEVICE HAVING INK AND LASER PRINTING UNITS

CROSS REFERENCE TO RELATED APPLICATIONS

The present application is a division of U.S. Ser. No. 09/402,755, filed Feb. 9, 2000, which issued as U.S. Pat. No. 6,305,858 which is a 371 of PCT/DE 98/01010 filed Apr. 8, 1998.

BACKGROUND OF THE INVENTION

The invention is directed to a heat-fed printing press and to a rotation printing press each respectively having at least one high-performance printing unit that, in particular, is a laser printing unit.

Laser and LED printers are currently distinguished by high-printing performance and printing quality in black-and-white printing. Printing performances of more than 50 pages per minute as well as a printing quality that comes close to that of offset printers are possible. Moreover, the manufacture and the operation of such printers are comparatively cost-beneficial. By contrast thereto, the technical preconditions for full-color laser printing are extremely involved and the on-going printing costs are very high.

Ink printers, also called ink jet printers, are often employed in conjunction with personal computers and in plotters since they cost-beneficially enable qualitatively high-grade color prints. The printing speeds obtainable with ink printers, however, are far, far lower then given laser printers so that ink printers have not yet been taken into consideration for the high-performance area.

JP-A-8 221 233 discloses a sheet-fed printing press with a plurality of printers that are respectively arranged at one of a plurality of parallel sheet transport paths. At their input side, these sheet transport paths are connected to a common sheet input path via sheet shunts. At the output side, the sheet transport paths are connected to a common sheet output path via sheet intermediate stores. The parallel arrangement of printing units serves the purpose of nonetheless being able to continue the printing process with the further available printing units given outage of one of the printing units. The printing of a sheet by at least two printing units is not addressed in this document. A bypassing of one of the printing units arranged parallel and a delivery of the sheets directly to the sheet output paths is also not disclosed in this document.

U.S. Pat. No. 5,140,674 discloses a serial arrangement of a color printer and a following monochromatic printer. Both printers print the same sheet, two-color printing being possible as a result thereof The serial arrangement of the two printers leads thereto that the printing unit with the lowest printing speed defines the speed of the printing process and, thus, the throughput of sheets.

EP-A-0 737 570 discloses a printing press with a plurality of printing units. These printing units are arranged serially following one another, i.e. the overall printing speed and the throughput of sheets is defined by the printing unit with the lowest printing speed. The printing units can also work according to different printing processes.

SUMMARY OF THE INVENTION

An object of the invention is to create a printing press that allows a fast, unproblemmatical and economical multi-printing and that can be simply and cost-beneficially manufactured.

The object is achieved by a sheet-feed printing press having at least one high-performance printing unit and a second printing unit with a common input and a common output. The second printing unit has a plurality of parallel sheet conveying paths which are connected at an input side to a common sheet input path via sheet shunts and the common sheet input path is connected to the input of the second printing unit, each of the plurality of sheet conveying paths has a multi-color or ink printing unit and discharges into a common sheet output path. The second printing unit also has a plurality of intermediate stores for sheets which are connected to the common output side and discharge into a common output path or transport path extending to the output of the second printing unit and the common sheet output path or transport path is connected by a shunt to the common sheet input path so that a sheet can be supplied to the common sheet output path while bypassing the multi-color printing units.

The invention makes it possible to unite the advantages of laser printing technology in black-and-white printing with the advantages of ink jet printing technology in color printing. In particular, mixed prints with text in black-and-white and additional, colored elements can be manufactured extremely economically.

Different color printing loads can be effectively buffered, so that the maximum speed prescribed by the laser printer can be adhered to over broad ranges. When the required color printing performance exceeds the performance capability of the ink or multi-color printing units, then the overall printing performance is not reduced discontinuously, as given conventional systems, but more or less continuously.

The invention can be employed not only given printers having a single laser printing unit but, for example, also given two-color laser printers in order to be able to implement an additional, full-color or partial-color printing. For example, laser-printed documents can be additionally provided with color accents, color backgrounds, chromatic, true-to-color company logos, negative entries in invoices in red or with the image of a company employee. The analogous case applies to single-color or two-color offset printing presses that are inventively equipped with additional ink printing units.

The ink printing units are preferably multi-color printing units but can also be organization color printing units, i.e. printing units for single-color where multi-printing without color mixing, what is referred to as a spot color printing. However, even in the case of predominantly spot color printing, multi-color printing units capable of color mixing are preferred, so that no complicated changes of color are required.

The sheet intermediate stores that compensate different printing speeds must in turn output the sheets input thereinto in an unaltered sequence. For example, stack sheet stores and shed sheet stores, whereby shed sheet stores work faster then stack sheet stores but generally have less capacity. In the preferred embodiment, a stack sheet store and a plurality of shed sheet stores are employed in common. In this way, extremely different printing jobs can also be carried out.

The sheets printed in the ink printing units can, as needed, be conducted to the various sheet intermediate stores when the plurality of parallel sheet transport paths discharge into the first common conveying or transport path that is connected to the plurality of sheet intermediate stores via further sheet shunts.

In a preferred embodiment of the invention, the sheet delivery to the ink printing units ensues via two-way shunts that are located in the common sheet input path of the ink printing units. The two-way shunts has a first output path that is connected via at least one further sheet shunt to the plurality of parallel sheet transport paths and has a second output path that discharges into the second common sheet output path of the sheet intermediate stores.

In the preferred embodiment, a sheet output path of the at least one high-performance printing unit is connected to the common sheet input path of the ink printing units, i.e. the ink printing units are arranged following the last high-performance printing unit in the sheet conveying direction. In this case, the common sheet output path of the sheet intermediate stores is, for example, connected to a final sheet store or to a means for sheet post-processing. Further, a control character sensor for control characters printed on the sheets by the high-performance printing unit can be arranged at the sheet output path of the at least one high-performance printing unit. The control characters can represent printing information for the ink printing units and/or sheet routing information for the sheet shunts.

For controlling the at least one high-performance printing unit and the plurality of ink printing units, either a common control unit is provided or each ink printing unit has a separate control unit that is connected to a main control unit of the printing press and controlled by this.

In the preferred embodiment, each ink printing unit forms an assembly together with a sheet conveying means that can be attached to the printing press or, respectively, removed therefrom independent of other assemblies. These assemblies and, as warranted, the ink printing units accommodated therein as well are identically constructed, so that they are interchangeable with one another.

The at least one high-performance printing unit, on the one hand and the ink printing units, sheet intermediate stores and sheet shunts, on the other hand, can be respectively accommodated in a separate housing, whereby the housing with the plurality of ink printing units is a removable attachment of the housing with the at least one high-performance printing unit. In this way, already existing printers can already be retrofitted with the invention. Corresponding devices that are already present in the housing with the at least one high-performance printing unit can be employed as final sheet store or as means for sheet post-processing.

Given a rotation printing press having a conveying path formed by rollers for a paper web and at least one-performance printing unit arranged at the conveying path, the aforementioned object is inventively achieved by a plurality of ink printing units that are arranged at intervals in a row along the conveying path, and in that a paper web intermediate store is located in the conveying path preceding each ink printing unit in paper conveying direction.

The paper web intermediate stores enable a speed compensation between the high-performance printing units and the ink printing units, whereby a plurality of ink printing units work in parallel. An even better adaptation to the greatest variety of different printing situations is enabled in that each printing unit has a drive for movement in the paper conveying direction.

Loop-forming devices are preferably employed as paper web intermediate stores, these being respectively composed of two stationarily seated deflection rollers and of an 180° deflection roller, whereby bearing locations of the 180° deflection roller are connected to a drive for moving the 180° deflection roller in the direction to the stationarily seated deflection rollers and away therefrom.

The developments described in conjunction with the inventive sheet-fed printing press are also partly possible and advantageous given the inventive rotation printing press.

Exemplary embodiments of the invention are explained below with reference to the drawings.

DESCRIPTION OF THE PREFERRED EMBODIMENTS

First Exemplary Embodiment

Figure 1:
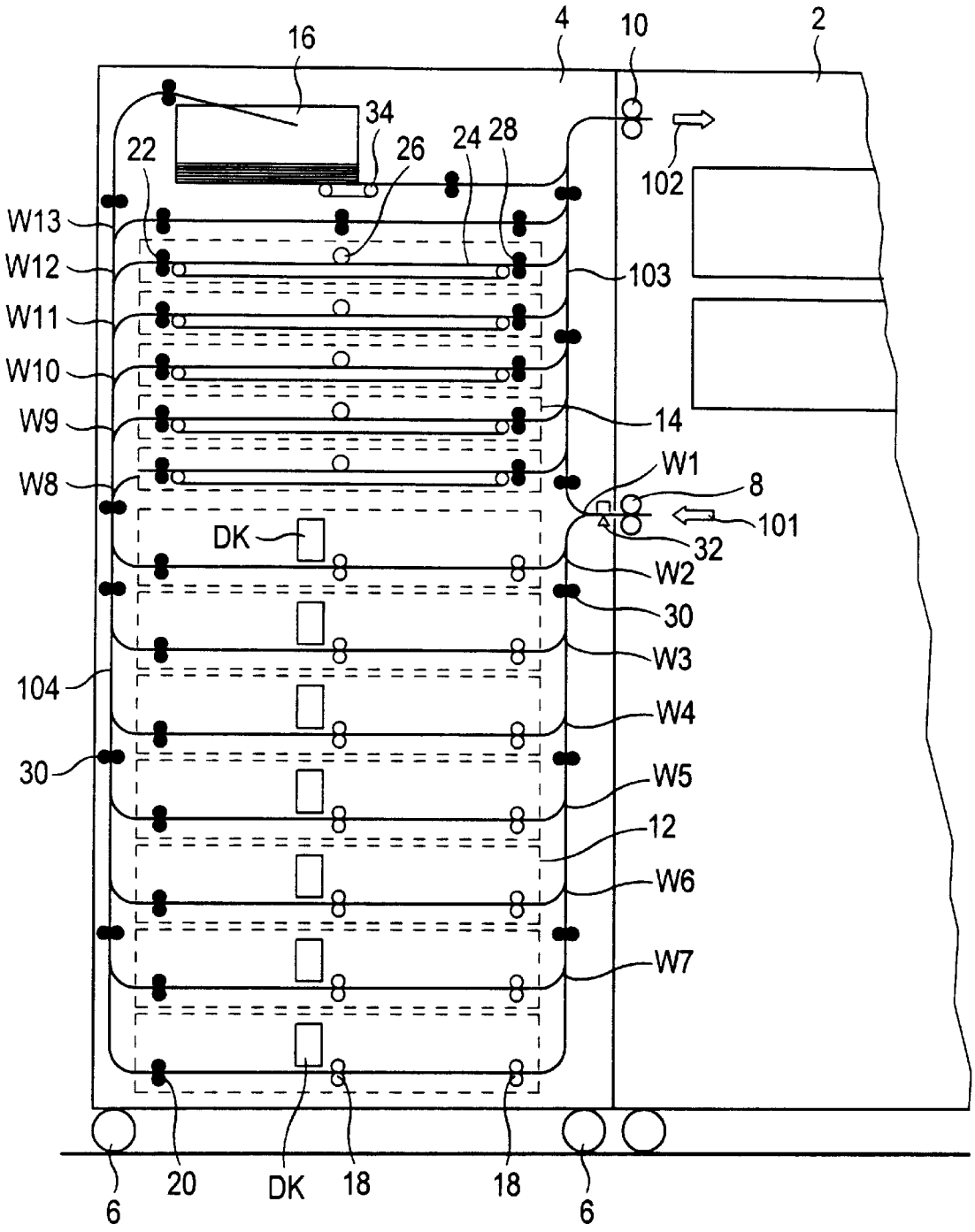
FIG. 1 is a partial cross-section through a sheet-fed printing press.

The sheet-fed printing press shown in FIG. 1 is composed of a high-performance laser printer with a housing 2 in which black-and-white laser printing unit, a control unit, sheet placement and removal means, sheet conveyor devices and, potentially, devices for sheet post-processing are accommodated. These conventional component parts of the laser printer are not shown in FIG. 1.

An attachment housing 4 that is detachably connected to the housing 2 adjoins the housing 2. The attachment housing 4 contains a sheet input opening (not shown) at the level of output rollers 8 of the high-performance laser printer which output sheets of paper, film or other materials to be printed from the housing 2 in the direction of arrow 101 and these have been printed in black-and-white by the laser printing unit.

The attachment housing 4 also comprises a sheet output opening (not shown) at the level of input rollers 10 of the high-performance laser printer. Sheets that have been processed in a way described later in the attachment housing 4 are in turn conveyed back into the housing 2 of the high-performance laser printer via the input rollers 10 in the direction of the arrow 102 where they are supplied to the devices for sheet post-processing, for example binding devices, or, respectively, to a final stacker.

In the detached condition, the attachment housing 4 can be moved away from the housing 2 of the high-performance laser printer on casters 6 and, in this condition, the two conveying paths of the sheets from and to the laser printer can be internally or externally connected to one another, so that the laser printer works like a conventional high-performance laser printer.

The lower part of the attachment housing 4 contains seven ink printing units 12 arranged above one another and the upper part thereof contains five shed deposits 14 arranged above one another and a stack deposit 16 arranged at the very top.

Each ink printing unit 12 contains two pair of draw-in rollers 18, a multi-color printing unit DK and a pair of haul-off rollers 20. Each printing unit DK is essentially composed of an ink printer head or ink jet printer head movable transversely relative to the sheet running direction, as utilized in high-performance plotters and color printers for personal computers with the colors yellow, magenta, cyan and black. The two pair of draw-in rollers 18 and the pair of haul-off rollers 20 respectively have their own drive, for example a stepping motor, so that the sheet draw-in and the sheet output of the ink printing units 12 can be implemented independent of one another.

Each ink printing unit 12 contains a separate control unit, also referred to as controller, that is controlled by the control unit of the laser printer functioning as a master. Each ink printing unit 12 forms an assembly (entered with broken lines) that can be inserted into or, respectively, withdrawn from a compartment in the attachment housing 4 perpendicularly to the plane of the figure in order to facilitate maintenance or the elimination of paper jams.

Each shed deposit 14 contains a pair of shed deposit draw-in rollers 22, an endless conveyor belt 24, a hold-down roller 26 adjoining the conveyor belt 24 and a pair of shed deposit haul-off rollers 28. Sheets drawn into a shed deposit 14 are scaled such onto the conveyor belt 24 that the sheet drawn in first can in turn be output first. The shed deposit 14, just like the ink printing units 12, can be separate assemblies in suitable compartments in the attachment housing 4. Each shed deposit 14 holds approximately ten sheets.

The stack deposit 16 is constructed such that approximately 200 sheets—with the most recently printed page down—are stacked on top of one another and are pulled off from below. The stack deposit 16 has a significantly greater capacity then the shed deposits 14 but does not enable as fast an intermediate storing of sheets as the shed deposits 14.

Sixteen conveyor roller pairs 30 that are driven by a common stepping motor and thirteen sheet shunts W1 through W13 form different conveying paths—shown with solid lines—from the output rollers 8 of the laser printer via the ink printing units 12 and the shed or, respectively, stack deposit 14, 16 following the input rollers 10 of the laser printer. The sheet shunts W1 through W13, which are structurally identical two-shunts in this exemplary embodiment, are only schematically indicated in the figure as branchings of the conveying paths.

A sensor is arranged immediately following the output rollers 8 of the laser printer, said sensor 32 acquiring codings or control characters that the laser printer printed onto the sheet edges and that contain information about the position and the type of color image to be printed on the respective sheet. The first sheet shunt W1 conducts a sheet output by the laser printer either in the direction toward the ink printing units 12 or directly to the input rollers 10 of the laser printer by a common sheet output path or transport path 103. The sheet shunt W1 can be controlled either by the control unit of the laser printer or it switches dependent on the sheet routing information that the laser printer printed on the sheets in addition to the print image information for the ink printing units 12. The same is also possible for the other sheet shunts W2 through W13, whereby additional control character sensors are provided as warranted.

A sheet conducted in the direction toward the ink printing units 12 is supplied to one of the ink printing units 12 via the sheet shunts W2 through W7 dependent on their momentary load. The respective ink printing unit 12 is controlled in conformity with the control characters read by the sensor 32, being controlled to apply a corresponding, chromatic print image onto the sheet, for example color accents, color backgrounds, a company logo, negative entries in invoices in red or a full image.

Sheets on which no color print are to be applied are allowed to pass empty through an ink printing unit 12. Following the ink printing units 12, the sheets are conducted onto a common conveying path 104, as indicated in the Figure by the merging conveying path lines. In that the two pair of draw-in rollers 18 and the pair of haul-off rollers 20 of each ink printing unit 12 respectively have their own drive, a sheet printed relatively slowly in an ink printing unit 12 can nonetheless be output very fast, so that no sheet collisions occur on the common conveying path 104 following the ink printing units 12.

A sheet conveyed on this common conveying path is supplied via the sheet shunts W8 through W12 to one of the five shed deposits 14 or via the sheet shunt W13 either to the stack deposit 16 or directly to the input rollers 10 of the laser printer dependent on the nature of the printing job. Due to the intermediate storage in the shed or, respectively, stack deposits 14, 16, sheets that have passed through the ink printing units faster then others are suitably delayed, so that all sheets are again placed into the proper sequence.

Conveying paths from the shed deposit haul-off rollers 28 and a pair of haul-off rollers 34 of the stack deposit 16, together with the conveying path from the sheet shunt W1, and at the input rollers 10 of the laser printer.

The operation of the disclosed heat-fed printing press is now explained in greater detail on the basis of exemplary printing jobs.

EXAMPLE 1

A plurality of individual letters are to be printed with text in black-and-white, a multi-color company logo and a green signature.

The first letter produced at maximum speed in the laser printer is supplied to the uppermost ink printing unit 12 in order to be provided with the company logo and the signature. Normally, the printing time for the color printing is significantly longer then the printing time for the black-and-white printing, so that the next letter is supplied to the next-lowest ink printing unit 12, etc. As soon as the printing in the uppermost ink printing unit 12 has ended, this has another letter supplied to it.

When the printing time for the color printing is exactly seven times as long as the printing time for the black-and-white printing, the seven ink printing units 12 are maximally loaded. The laser printer is also maximally loaded except when the printing time for the color printing amounts to more than seven times the printing time for the black-and-white printing. In this case, the printing speed of the laser printer must be successively reduced.

The letters printed black-and-white and in color in the ink printing units 12 can be directly conveyed back to the laser printer when their sequence is of no concern. Otherwise, the letters are distributed via the sheet shunts W8 through W12 in sequence onto the five shed deposits 14 from which they are in turn output in the correct sequence.

EXAMPLE 2

A plurality of individual documents are to be printed, each being composed of a letter with a multi-color company logo and a green signature as well as an appertaining invoice with negative entries in red.

A black-and-white letter and the appertaining invoice are respectively successively printed in the laser printer, and, just as in Example 1, these are successively distributed onto the ink printing units 12. Since the printing time for the color printing of the invoices is significantly shorter then that of the letter, the finished invoices printed red are supplied to the stack deposit 16 and are intermediately stored therein, whereas the letters—as in the first example—are distributed onto the shed deposits 14. The letters and invoices are then output in the proper sequence and mutual allocation from the shed deposits 14 and the stack deposits 16 and are supplied to a final stacker in the laser printer.

Due to the great capacity of the stack deposit 16, a great number of documents can be printed at maximum speed before the printing speed of the laser printer must be reduced.

EXAMPLE 3

Brochures are to be printed that are mainly black-and-white but that contain a color photo of the first sheet and graphics with a colored background on a few following sheets with a higher page number.

The laser printer successively outputs all pages of the brochure with maximum speed. Black-and-white initial sheets before the sheet with the color photo are supplied directly to the input rollers 10 of the laser printer from the shunt W1, and, while the color photo is being printed in one of the ink printing units 12, the laser printer continues to work in order to print the next black-and-white sheet. These are allowed to pass through one of the ink printing units 12 without processing and are supplied to the stack deposit 16.

When it is time for the graphics having a colored background, the color photograph, which is complicated to produce, may be possibly still being printed. In a way similar to the first example, the color of the graphics is then applied by the ink printing units 12 that are still free. The sheets with the graphics are stored in one of the shed stores 14 while the printing of the color photo is completed.

The sheet with the completely printed color photo is supplied directly to the laser printer and, subsequently, the other pages are compiled from the shed and stack stores 14, 16. If there is still free storage capacity therein, following pages that only contain black-and-white text can continue to be printed in the meantime with maximum speed. The brochure stack compiled in the laser printer is turned over in the laser printer in order to print the backsides of the sheets and are bound after a second pass.

It was assumed for the purpose of a simpler explanation in the third example that a brochure is completely printed before the processing of the next brochure is begun. In this case, it can be necessary to at least temporarily reduce the printing speed of the laser printer if many pages having colored elements follow one another. A plurality of intermediate stores that differ in terms of speed and capacity, however, offer versatile possibilities for a mutual interleaving of the work procedures for a plurality of brochures, so that it can also be possible in such a case to retain the maximum printing speed to the farthest-reaching extent.

Second Exemplary Embodiment

A second exemplary embodiment is now explained with reference to FIG. 2, this referring to a rotation printing press that, for example, can be roller offset printing press or a roller laser printing press.

Figure 2:
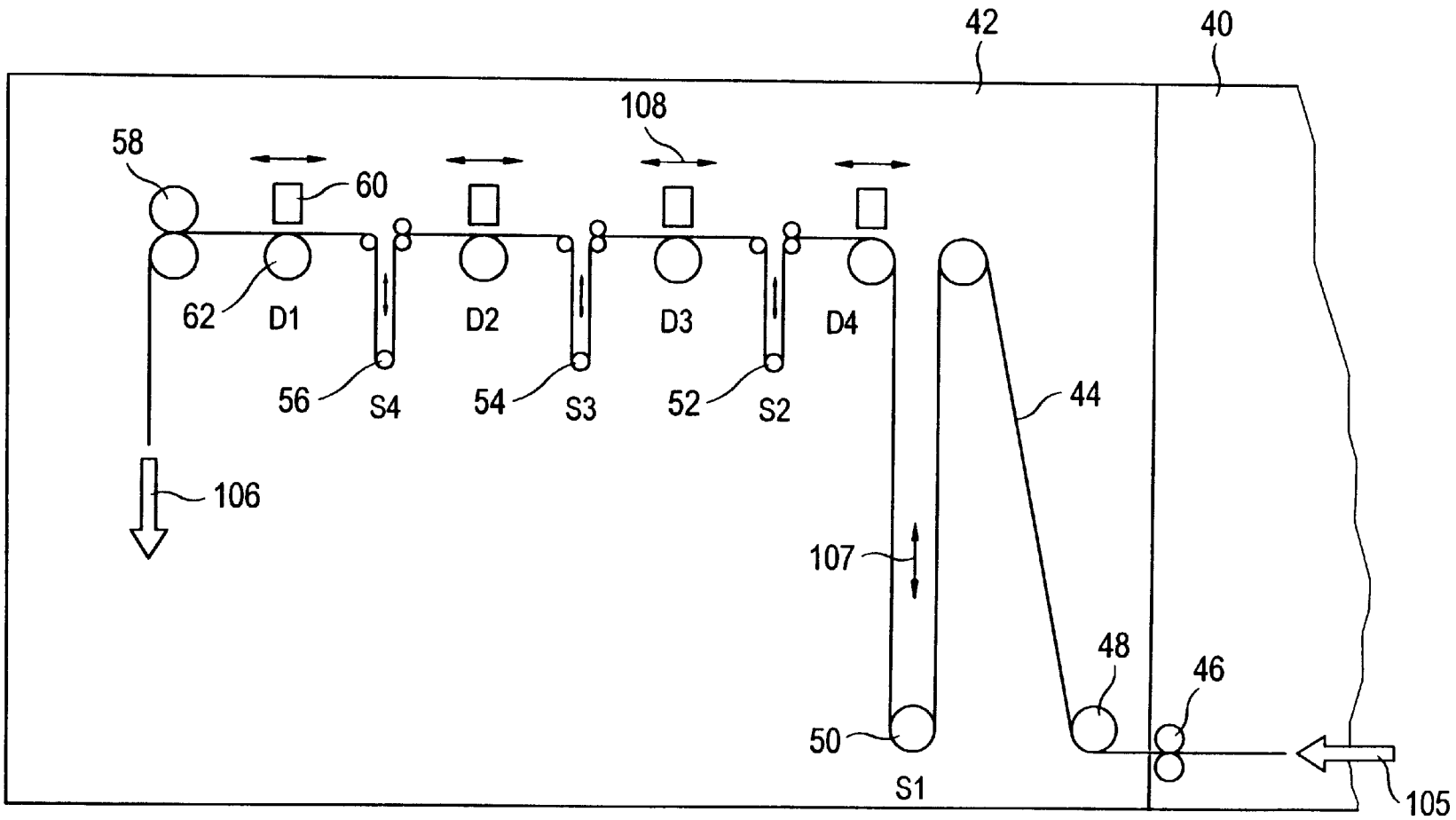
FIG. 2 is a partial cross-section through a rotation printing press.

An attachment frame 42 that is only schematically entered is attached to a conventional rotation printing press, whereof only one end of a machine frame 40 is schematically entered in FIG. 2. A paper web 44 that is conducted through a pair of output rollers 46 of the rotation printing press in the direction of arrow 105 is conducted over a number of deflection rollers in the auxiliary frame 42 and is subsequently supplied to a stacker (not shown) in the direction of the arrow 106 at the end of the paper web.

After the paper web 44 has passed an input deflection roller 48, it passes through four loop-forming means S1, S2, S3 and S4. Each loop-forming means S1 through S4 is composed of two stationary deflection rollers seated at the auxiliary frame 42 and of a 180° deflection roller 50, 52, 54 or, respectively, 56. Each 180° deflection roller 50, 52, 54 and 56 can be moved upward and downward in the direction toward and away from the stationarily seated deflection rollers, as indicated by vertical double arrows 107. To this end, for example, bearing blocks of the 180° deflection rollers 50, 52, 54 and 56 or the like are displaceable in vertical rails at the auxiliary frame 42. Each loop-forming means S1 through S4 has a separate drive for the vertical movement of its 180° deflection roller 50, 52, 54 and 56.

The stationarily seated deflection rollers of the loop-forming means S1 through S4 all lie in a horizontal plane, whereby the two stationary deflection rollers of a loop-forming means S1, S2, S3 or S4 are arranged at a distance from the appertaining 180° deflection roller and there is a greater distance between respectively two loop-forming means S1, S2, S3 or, respectively, S4. The paper web 44 is conducted such through the loop-forming means S1 through S4 that it respectively proceeds via a straight path between the neighboring, stationary deflection rollers of respectively two loop-forming means S1 through S4 as well as between the last stationary deflection roller of the loop-forming means S4 viewed in paper conveying direction and a pair of output rollers 58.

A respective ink printing unit D4, D3, D2 and D1 is arranged along each of these straight paths. Each ink printing unit D1 through D4 contains a multi-color ink jet printing head 60 of the same type as described in conjunction with the sheet-fed printing press of FIG. 1. Moreover, each ink printing unit D1 through D4 contains a counter-pressure roller 62, whereby the paper web 44 passes through between each printing head 60 and the appertaining counter-pressure roller 62. The ink printing units D1 through D4 can be respectively moved back and forth somewhat parallel to the horizontal plane that is formed by the stationarily seated deflection rollers of the loop-forming means S1 through S4, as indicated by horizontal double arrows 108 in the Figure.

The drives for the vertical movement of the 180° deflection rollers 50 through 56 as well as drives (likewise not shown) for the horizontal movement of the ink printing units D1 through D4 are controlled by a main control unit of the rotation printing press or by the control units of the individual ink printing units D1 through D4 so that the loop-forming means S1 through S4 form variable paper web intermediate stores preceding each ink printing unit D1 through D4 that compensate for the different printing speeds of the laser or offset printer and the ink printing units D1 through D4. Additional station possibilities are established by the horizontal mobility of the individual ink printing units D1 through D4.

The print images produced at high speed in the rotation printing that, for example, are black-and-white or two-colored, can, just as in the exemplary embodiment of the sheet-fed printing press, the additionally provided with multi-color color accents, color backgrounds, chromatic, true-to-color company logos, etc., in the ink printing units D1 through D4 without having to reduce the printing speed. For example, four successive black-and-white print images on the paper web 44 are printed multi-color essentially isochronically in the four ink printing units D1 through D4.

Similar to the exemplary embodiment of FIG. 1, a control character sensor for control characters printed onto the paper web 44 by the high-performance printing unit can be provided in the exemplary embodiment of FIG. 2, whereby the control characters represent printing information for the ink printing units D1 through D4 or, respectively, length control information for the loop-forming means S1 through S4.

In the two exemplary embodiments of FIG. 1 and FIG. 2, the ink printing units 12 or, respectively, D1 through D4 are respectively arranged following the high-performance printing unit or units as viewed in paper conveying direction. Alternatively, it is possible to arrange the ink printing units 12 or, respectively, D1 through D4 preceding the high-performance printing units as viewed in paper conveying direction or between high-performance printing units. Although the high-performance printing units of the exemplary embodiments were described as laser printers, it is clear that other printing units can also be employed for this purpose, particularly printing units wherein the registration is accomplished with light-emitting diodes (LEDs). In particular, electrographic, magneto-graphic or ionographic processes are suitable as developing processes for the described high-performance printing units.

I claim:

1. A printing press having a conveying path for a paper web formed by rollers and having at least one high-performance printing unit arranged at the conveying path, a plurality of multi-color printing units being arranged along the conveying path at intervals in a row, said multi-color printing units having lower printing speed than the at least one high-performance printing unit; and a variable paper web intermediate store being located in the conveying path preceding each multi-color printing unit as viewed in a paper web conveying direction.

2. A printing press according to claim 1, wherein the paper web intermediate stores are loop-forming devices.

3. A printing press according to claim 2, wherein each loop-forming device is composed of two stationarily seated deflection rollers and a 180° deflection roller, whereby bearing locations of the 180° roller are connected to a drive for moving the 180° deflection roller in the direction toward and away from the stationarily seated deflection rollers.

4. A printing press according to claim 1, wherein each multi-color printing unit is connected to a drive for movement in the paper conveying direction.

5. A printing press according to claim 1, wherein the high-performance printing unit is a laser printing unit.

6. A printing press according to claim 1, wherein at least one of the multi-color printing units is an ink jet printing unit.

7. A printing press according to claim 1, wherein the multi-color printing units are arranged following the high-performance printing unit in the paper conveying direction.

8. A printing press according to claim 1, wherein a control character sensor for control characters printed onto the paper web by a high-performance printing unit is arranged between the high-performance printing unit and the multi-color printing units.

9. A printing press according to claim 8, wherein the control characters represent printing information for the multi-color printing units.

10. A printing press according to claim 1, wherein a common control unit is provided for the at least one high-performance printing unit and the plurality of multi-color printing units.

11. A printing press according to claim 1, wherein each multi-color printing unit has a separate control unit that is connected to a main control unit of the printing press.

12. A printing press according to claim 1, wherein the multi-color printing units and the paper web intermediate stores are accommodated in a frame that represents a detachable part of a machine frame in which the at least one high-performance printing unit is accommodated.

13. A printing press having a conveying path for a paper web formed by rollers and having at least one high-performance printing unit arranged at the conveying path, a plurality of ink jet printing units having a printing rate lower than the at least one high-performance printing unit being arranged along the conveying path at intervals in a row; and a paper web intermediate store being located in the conveying path preceding each ink jet printing unit as viewed in a paper web conveying direction.

14. A method of printing a paper web with at least one high-performance printing unit for printing black-and-white, and a plurality of multi-color printing units, said method comprising conveying the paper web through the high-performance printing unit and then through a plurality of multi-color printing units, changing the path of the web to store portions of the web between each of the multi-color printing units so that the rate of printing in the multi-color printing units is compensated.

15. A method of printing a paper web with at least one high-performance printing unit for printing black-and-white, and a plurality of ink jet printing units, said method comprising conveying the paper web through the high-performance printing unit and then through a plurality of ink jet printing units, changing the path of the web to store portions of the web between each of the ink jet printing units so that the rate of printing in the ink jet printing units is compensated.

* * * * *